US011826818B2

(12) United States Patent
Swank

(10) Patent No.: US 11,826,818 B2
(45) Date of Patent: Nov. 28, 2023

(54) BORON STEEL HIGH-PRESSURE CARTRIDGE CASE

(71) Applicant: Luvata Ohio Inc., Delaware, OH (US)

(72) Inventor: Brian Swank, Delaware, OH (US)

(73) Assignee: LUVATA OHIO, INC., Delaware, OH (US)

( * ) Notice: Subject to any disclaimer, the term of this patent is extended or adjusted under 35 U.S.C. 154(b) by 0 days.

(21) Appl. No.: 17/484,089

(22) Filed: Sep. 24, 2021

(65) Prior Publication Data

US 2022/0097124 A1 Mar. 31, 2022

Related U.S. Application Data

(60) Provisional application No. 63/083,833, filed on Sep. 25, 2020.

(51) Int. Cl.

| | |
|---|---|
| ***F42B 5/28*** | (2006.01) |
| ***B21K 21/04*** | (2006.01) |
| ***F42B 5/295*** | (2006.01) |
| ***C22C 38/00*** | (2006.01) |
| ***C21D 7/02*** | (2006.01) |
| ***C22C 38/04*** | (2006.01) |
| ***C21D 8/06*** | (2006.01) |
| ***C21D 9/16*** | (2006.01) |
| ***C22C 38/02*** | (2006.01) |

(52) U.S. Cl.

CPC ..... *B21K 21/04* (2013.01); *C21D 7/02* (2013.01); *C21D 8/065* (2013.01); *C21D 9/16* (2013.01); *C22C 38/002* (2013.01); *C22C 38/02* (2013.01); *C22C 38/04* (2013.01); *F42B 5/28* (2013.01); *F42B 5/295* (2013.01)

(58) Field of Classification Search

CPC ..... F42B 33/00; F42B 33/001; F42B 5/26; F42B 5/28; F42B 5/295; B21K 21/04

See application file for complete search history.

(56) References Cited

U.S. PATENT DOCUMENTS

| | | | | |
|---|---|---|---|---|
| 2,726,181 | A | 12/1955 | Lyon | |
| 2,915,424 | A * | 12/1959 | Lyon | F42B 5/28 86/19.5 |
| 3,049,998 | A | 8/1962 | Brown | |
| 3,830,157 | A | 8/1974 | Donnard et al. | |

(Continued)

FOREIGN PATENT DOCUMENTS

| | | |
|---|---|---|
| GB | 1445533 | 8/1976 |
| KR | 20170115726 | 10/2017 |

OTHER PUBLICATIONS

WIPO, International Search Report and Written Opinion for International Application No. PCT/US2021/052196, dated Jan. 11, 2022.

*Primary Examiner* — Jonathan C Weber

(74) *Attorney, Agent, or Firm* — HODGSON RUSS LLP

(57) ABSTRACT

A boron steel high pressure cartridge case and method of manufacturing the same is provided. The method includes cold forming a cartridge case into a drawn blank or a tubular component; annealing the cartridge case using a belt furnace, flame furnace, induction furnace, or a batch furnace; performing a machine ejector slot and trim on the cartridge case; forming the shoulder and neck of the cartridge case; performing a heat treatment of the cartridge case; and tempering the cartridge case. The cartridge case is fabricated of boron steel including ≤1.0% boron.

20 Claims, 8 Drawing Sheets

(56) References Cited

U.S. PATENT DOCUMENTS

| | | | | |
|---|---|---|---|---|
| 4,041,868 | A | 8/1977 | Rayle et al. | |
| 10,495,430 | B2 | 12/2019 | Carper et al. | |
| 2019/0226817 | A1* | 7/2019 | Imhoff | F42B 5/285 |
| 2020/0182594 | A1* | 6/2020 | Imhoff | F42B 5/285 |

* cited by examiner

BORON STEEL HIGH-PRESSURE CARTRIDGE CASE

CROSS-REFERENCE TO RELATED APPLICATIONS

This disclosure is based on, and claims priority to, U.S. Provisional Application No. 63/083,833, filed on Sep. 25, 2020, the entire disclosure of which is incorporated by reference herein.

FIELD OF THE DISCLOSURE

This disclosure relates to formation of cartridge cases for firearms.

BACKGROUND OF THE DISCLOSURE

Cases for firearm cartridges are conventionally made with numerous steps on successive machines. Traditionally, cartridge cases are formed from brass strip stock that is cupped and then drawn in multiple stages. Annealing steps between the drawing stages are ordinarily required, especially where relatively long cartridge cases, such as rifle cartridge cases, are being manufactured. The strip stock method produces a high scrap ratio, requires energy for annealing, is slow and prone to dimensional variability, and occupies considerable floor space.

A typical rifle cartridge is designed to operate at 60,000 psi and withstand a proof load at 78,000 psi. In these conditions, materials such as brass (C26000) or low carbon steel (AISI-1017, AISI-1018, AISI-1020 and AISI-1030) can be used. When the pressure exceeds 80,000 psi these materials may fail due to loss of primer cups from the cartridge case, rupture of the cartridge case, or excessive extraction force to remove the spent cartridge case from the chamber. The high extraction force is encountered when the spring back of the material, defined as the ratio of yield strength to Young's Modulus, approaches a low critical limit.

Therefore, an improved manufacturing method and resulting cartridge cases are needed.

BRIEF SUMMARY OF THE DISCLOSURE

The embodiments disclosed herein provide a process for manufacturing a high-pressure rifle cartridge case with increased propellant capacity that allows for higher pressures to be obtained, resulting in improved projectile muzzle velocity.

According to an embodiment of the present disclosure, the method may comprise cold forming a cartridge case into a drawn blank or a tubular component. The cartridge case may be fabricated of boron steel. The method may further comprise annealing the cartridge case using a belt furnace, flame furnace, induction furnace, or a batch furnace. The method may further comprise performing a machine ejector slot and trim on the cartridge case. The method may further comprise forming the shoulder and neck of the cartridge case. The method may further comprise performing a heat treatment of the cartridge case. The method may further comprise tempering the cartridge case.

According to an embodiment of the present disclosure, the cartridge case may include a phosphorus and polymer coating.

According to an embodiment of the present disclosure, the boron steel may be spherodized annealed at finished size (SAFS).

According to an embodiment of the present disclosure, the annealing may be configured to provide stress relief.

According to an embodiment of the present disclosure, the annealing may occur at a temperature from between 900° F. and 1100° F. for 10 minutes to 15 minutes.

According to an embodiment of the present disclosure, the heat treatment may occur at a temperature between 1600° F. and 1650° F. for 25 minutes to 40 minutes.

According to an embodiment of the present disclosure, the tempering may occur at a temperature between 575° F. and 625° F. for two hours.

According to an embodiment of the present disclosure, the method may further comprise filling an interior volume of the cartridge case with a propellant. After firing the cartridge case from a weapon, the method may further comprise re-filling the interior volume of the cartridge case with additional propellant.

The ability to increase the chamber pressure of a rifle cartridge case has an impact on the muzzle velocity of a projectile, which is directly related to the overall effectiveness of the weapon system. Increased muzzle velocity benefits the user by flattening the trajectory of the projectile, reduces the effect of outside environmental influences such as wind deflection, and improves or extends the range of the terminal performance capability. Having a rifle cartridge case that is able to withstand higher pressures while exerting less radial force on the retaining chamber wall than a brass cartridge case is beneficial because it may allow for the design of lighter weight weapon barrels.

Increasing the volume capacity of the cartridge case can provide advantages. First, it can allow for more propellant to be added to the cartridge. This is advantageous as it allows for a wider range of choices in optimized propellant type selection. Second, it can allow for a heavier weight bullet to be installed into the cartridge that ordinarily would intrude too far into the propellant bed of a standard brass cartridge case. Increasing the volume capacity of a cartridge case can be obtained by decreasing the thickness of the cartridge case walls. The strength of the material becomes more important if the cartridge case walls are thinned.

Embodiments disclosed herein can improve small arms ammunition calibers from .50 caliber and below. Typical applications include legacy cartridges such as 223 Remington, 5.56×45 mm NATO, 6.5 mm Creedmoor, 308 Winchester, 7.62×51 mm NATO, and .50 caliber BMG as well as U.S. Army's next-generation efforts such as high pressure cartridge designs in 6.8 mm.

Embodiments of the disclosed process for manufacturing a high pressure and increased propellant capacity rifle cartridge case allow for higher pressures to be obtained by the cartridge and allow the projectile to reach speeds in excess of 3,200 feet per second.

According to an embodiment of the present disclosure, the cartridge case may comprise a cartridge body having a tubular shape with an ejector slot, a shoulder, and a neck. The cartridge body may be comprised of a boron steel comprising ≤1.0% boron.

According to an embodiment of the present disclosure, the boron steel may comprise 0.0008% to 0.0030% boron.

According to an embodiment of the present disclosure, the cartridge body may further comprise 0.18% to 0.23% carbon; ≤0.25% silicon; 0.7% to 1.0% manganese; ≤0.03% phosphorous; and ≤0.01% sulfur.

According to an embodiment of the present disclosure, the boron steel may have a yield strength of more than 80,000 psi.

According to an embodiment of the present disclosure, the cartridge case may withstand a pressure of up to 120 ksi.

According to an embodiment of the present disclosure, the boron steel may have a hardness between 35 to 45 HRC.

According to an embodiment of the present disclosure, the cartridge body may includes a surface coating. The surface coating may be an electroless nickel plating.

According to an embodiment of the present disclosure, the tubular shape of the cartridge body may be cold formed from sheared lengths of a coil.

According to an embodiment of the present disclosure, the cartridge body is heat treated at a temperature between 1600° F. and 1650° F. for 25 minutes to 40 minutes.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural, logical, process step, and electronic changes may be made without departing from the scope of the disclosure. Accordingly, the scope of the disclosure is defined only by reference to the appended claims.

Embodiments disclosed herein provide a method to manufacture a high-pressure cartridge case. The manufacturing method may include one of the following: stamping, cold forming, metal injection molding, or machining of the cartridge case. Cold forming of the cartridge case may be desirable because improved grain structure orientation can be achieved. To minimize component cost to yield strength ratio, boron steels may be used. Other steel or stainless steel alloys that have a yield strength in excess of 80,000 psi may also be used including, for example, 300- and 400-series stainless steel, 17-4 stainless steel, 4000-series steel, or precipitation-hardened copper alloys. These other steel or stainless steel alloys may provide improved corrosion resistance.

Figure 1:
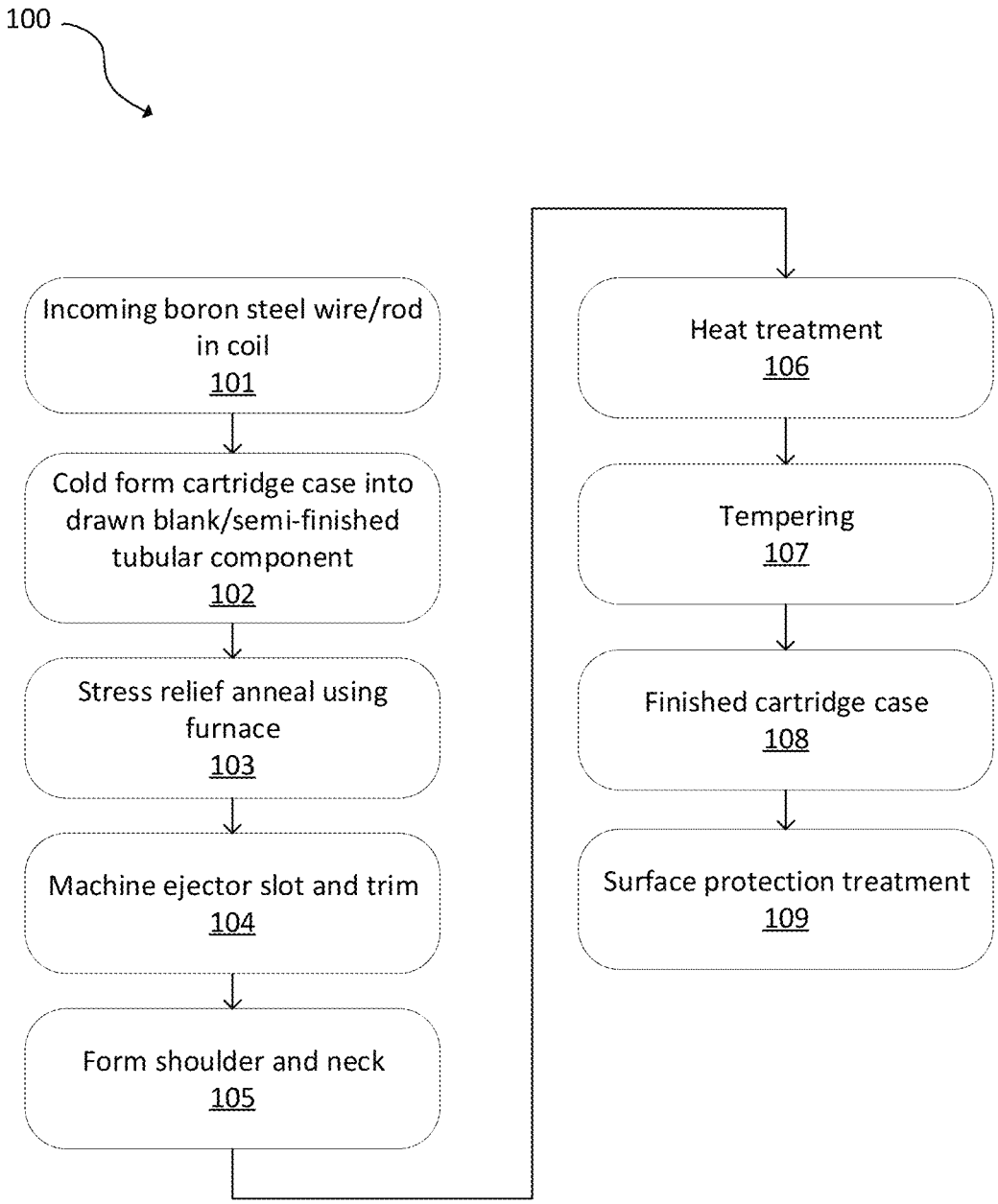
FIG. 1 is a flowchart of an embodiment of a method in accordance with the present disclosure.

FIG. 1 is a flowchart of an embodiment of a method 100 in accordance with the present disclosure. The method 100 can be used to manufacture high-pressure cartridge case from boron steel or other materials with an increased capacity for propellant. The exemplary cartridge cases in the method 100 are manufactured from boron steel, but other materials can be used instead of boron steel.

The boron steel wire or rod can start in the form of a coil 101, though other shapes are possible. The incoming boron steel wire or rod may have a carbon (C) content from approximately 0.18% to 0.23%, silicon (Si) of approximately ≤0.25%, manganese (Mn) from approximately 0.70% to 1.00%, phosphorus (P) of approximately ≤0.030%, sulfur (S) of approximately ≤0.010% and boron (B) from approximately ≤1.00%. The values of these components may be greater than zero. Higher carbon content boron steels or higher boron contents may be selected, but are not necessary to obtain the desired physical properties to produce the high-pressure rifle cartridge case. According to an embodiment of the present disclosure, the boron level may be ≥0.0008% to 0.0030%. Boron levels greater than 0.0030% may reduce the hardenability and toughness of the steel and can increase the brittleness of the steel as such excessive boron levels may allow for the boron constituents to become segregated in the austenite grain boundaries. By limiting the sulfur content, issues arising from brittleness and cracking of the cartridge may be minimized.

The boron steel can be spherodized annealed at finished size (SAFS). The incoming wire or rod can be spherodized annealed to improve the ductility of the boron steel for cold forming. Spherodized annealing is generally done on wire that was work-hardened during the process of drawing it to final size. This can allow further cold work to be performed on the wire. This resulting wire after spherodized annealing can have improved ductility and toughness with reduced hardness and strength. Spherodized annealing of the wire may be carried out under a protective (endothermic) atmosphere to prevent oxidation and decarburization. Elimination of decarburization at each heat treating step can reduce or eliminate the possibility of weak spots in the cartridge case. The targeted hardness range after heat treating can be 35 to 45 HRC providing a minimum yield strength of 140 ksi.

Spherodized annealing at final size or in process may increase the amount of cold work that may be performed on the wire and therefore reduce the chance of the cartridge case cracking.

Corrosion protection of the boron steel cases can be achieved by a lacquer coating, nickel plating, or other coating/plating.

The boron steel also can include a phosphorus and polymer coating. After spherodized annealing, the wire or rod can be coated with a high phosphorus and polymer coating. This coating can decrease the friction between the progressive cold forming dies and incoming wire during plastic deformation to produce the cartridge case. While some embodiments use such a coating, other embodiments may dispense with a coating provided that cold forming lubricants can minimize the wear to the contact tooling during forming.

A cartridge case is cold formed into a drawn blank or a tubular component at 102 using the boron steel. To create a cartridge case that can withstand pressures of up to 120 ksi and minimize weight, the sidewall of the cartridge case may be profiled. Producing a blank with a profiled wall by cold forming can obtain nearly a 100% yield of the raw material. Other forming methods such as the conventional rifle cartridge case approach from strip, a modified cold forming sequence, machining the cartridge case from a boron steel rod, or other techniques also may also be used. Other formation techniques are possible.

Figure 2:
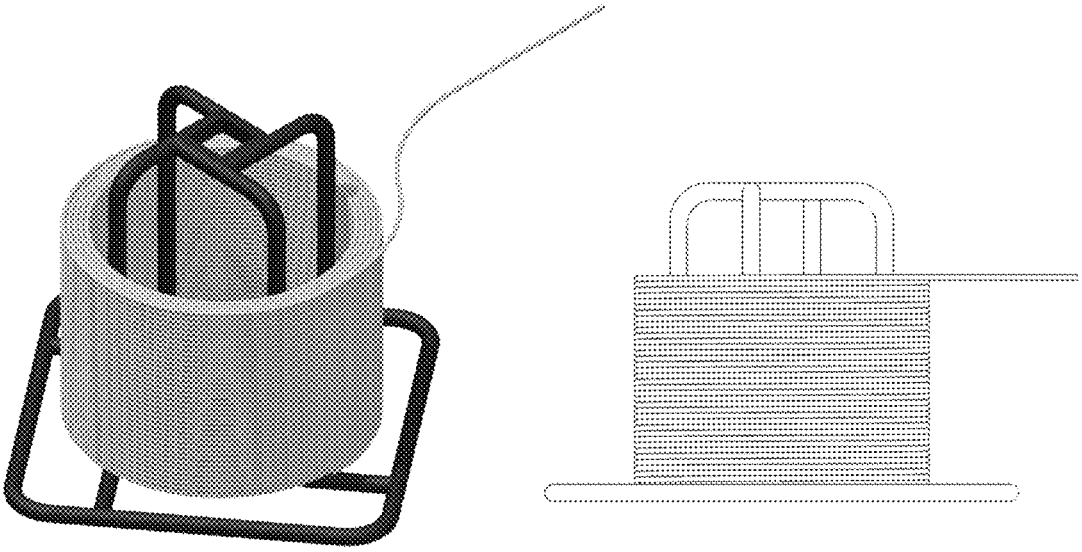
FIG. 2 illustrates a perspective and side elevation view of a continuous coil of SAFS boron steel.

In an embodiment, the cartridge case is formed from a continuous coil of SAFS boron steel, as illustrated in FIG. 2, from a long cartridge case blank. See the method disclosed in U.S. Pat. No. 10,495,430, which is incorporated by reference in its entirety.

Figure 3:
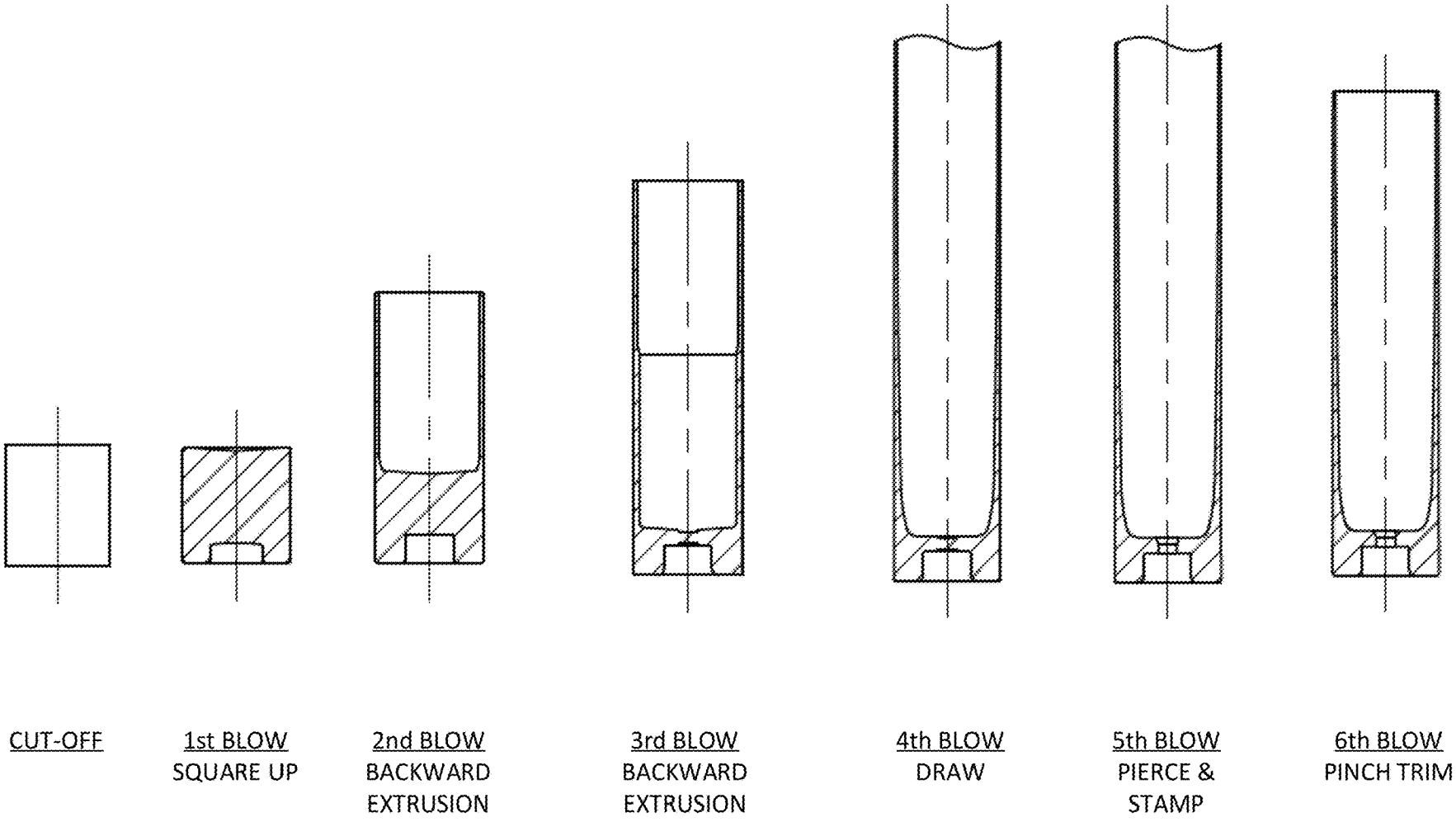
FIG. 3 illustrates cold formation into a tubular blank.

During cold forming of the cartridge case 102, the wire can be sheared off from the master coil and then progressively cold formed into a tubular blank. This is shown in FIG. 3.

Figure 4:
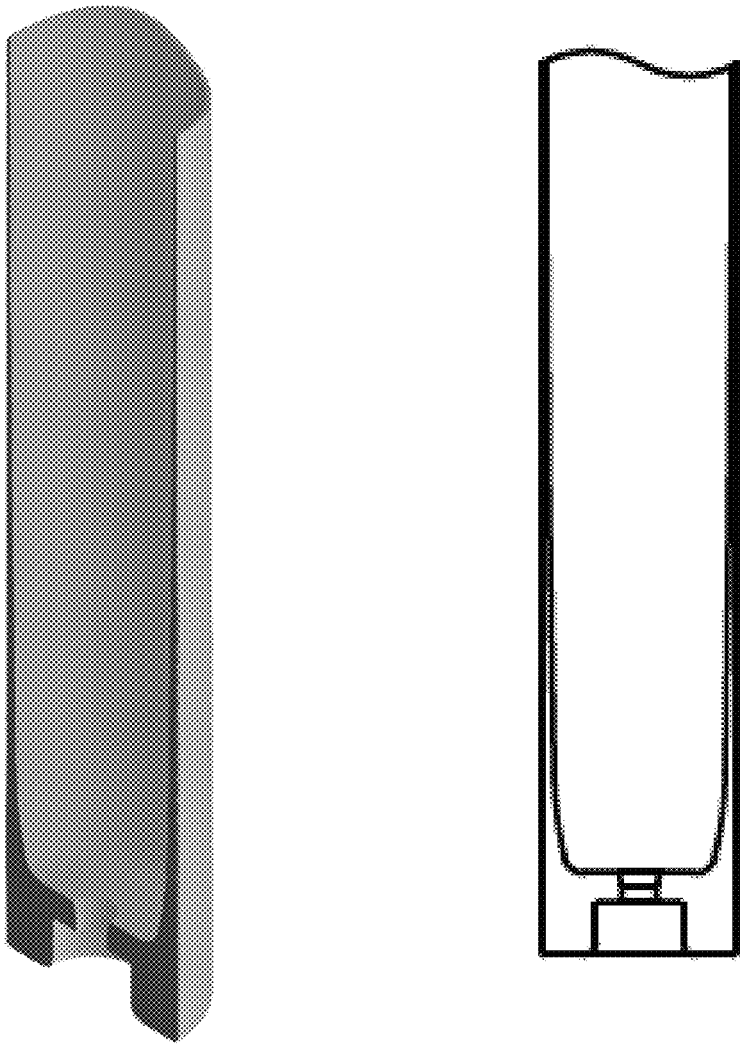
FIG. 4 is an embodiment of a desired cartridge case blank after forming.

Since the cartridge case is cold formed, no heat treatment may be required during the process of forming the rifle cartridge case blank from the boron steel wire. FIG. 4 is an example of the desired cartridge case blank after forming. The ductility of the wire after spherodized annealing can be sufficient to allow for the material to be cold worked into a near net shaped cartridge case with the possible exception of the ejector slot machining, mouth trim/chamfer, and shoulder/necking. In other conventional processes, the rifle cartridge case blank is annealed two to three times to achieve the desired configuration as shown in FIG. 4, which increases manufacturing costs and can reduce throughput.

After cold forming of the rifle case tube blank, the boron steel can be stress relief annealed to improve the ductility. The ductility can affect later shouldering and necking. The cartridge case can be annealed using a belt furnace, flame furnace, induction furnace, or batch furnace at 103. Direct exposure to flame also can be used. The annealing 103 can be configured to provide stress relief. The belt furnace, batch furnace, or other furnace can have an endothermic atmosphere or can have an atmosphere with nitrogen and up to 4% hydrogen.

The annealing using the furnace 103 can occur at a temperature from approximately 900° F. to approximately 1100° F. for approximately 10 to 15 minutes. For example, annealing 103 may be performed for 10 minutes. In an embodiment, a temperature of 1020° F. is used during annealing using a belt furnace or a batch furnace 103. Stress relief annealing temperatures below 900° F. may cause the rifle cartridge case to crack or buckle during the shoulder and necking operation. Stress relief annealing temperatures above 1100° F. may start to harden the steel since the cooling rate of the tubular blank is high given its thin wall. If the temperature is too high, the structure of the steel may change from ferrite to austenite. Using annealing using a belt furnace or a batch furnace 103, the finished cartridge case needs a final heat treatment in order to obtain the required final physical properties.

If the cartridge case is annealed using a furnace at 103, the machine ejector slot and trim is performed on the cartridge case at 104 and the shoulder and neck of the cartridge case are formed at 105. Annealing at 103 is performed such that stresses induced during cold forming are reduced by recovering strain energy induced into the cartridge case. The cartridge case is then subject to heat treatment 106 and tempering 107 after the shoulder and neck are formed 105. Then the cartridge case may be sufficiently complete at 108. The heat treatment 106 can occur at a temperature from 1600° F. to 1650° F. (e.g., 1615° F.) for approximately 25 to 40 minutes (e.g., 38 minutes). The tempering 107 can occur at a temperature from 575° F. to 625° F. (e.g., 600° F.) for approximately 2 to 3 hours (e.g., approximately 2 hours). Heat treatment 106 and tempering 107 may occur at other temperatures which may be desirable based on the application. For example, a softer tempering may be desirable when reducing bolt thrust force on the weapon system. Different tempering can be achieved by adjusting the temperature during heat treatment 106 and/or tempering 107.

An optional surface protection treatment 109 can be performed after the cartridge case is finished at 108.

After the blank has been relief annealed, the ejector slot can be machined into the head of the case and the mouth opening can be trimmed and chamfered. This may be done before or after shouldering or necking.

Figure 5:
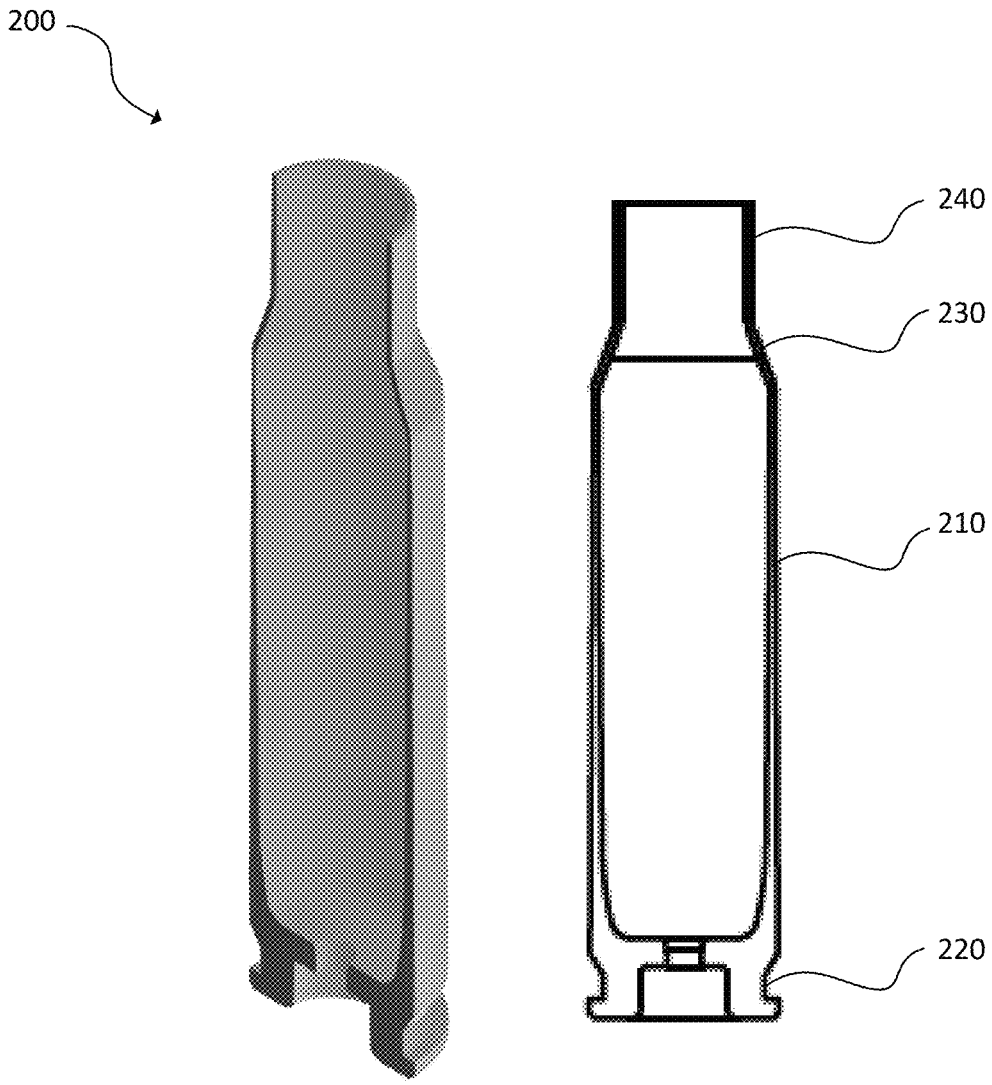
FIG. 5 is an exemplary finished rifle cartridge case configuration in accordance with the present disclosure.

Following the machining operation, the rifle cartridge case blank can be shouldered and necked at 105. Shouldering and necking is typically completed in two or three forming stations. FIG. 5 shows an exemplary finished rifle cartridge case 200 configuration. Cartridge case 200 may comprise a cartridge body 210 having a tubular shape. An ejector slot 220 may be machined at a lower end of the cartridge body 210, and a shoulder 230 and a neck 240 may be formed at an upper end of the cartridge body 210.

Figure 6:
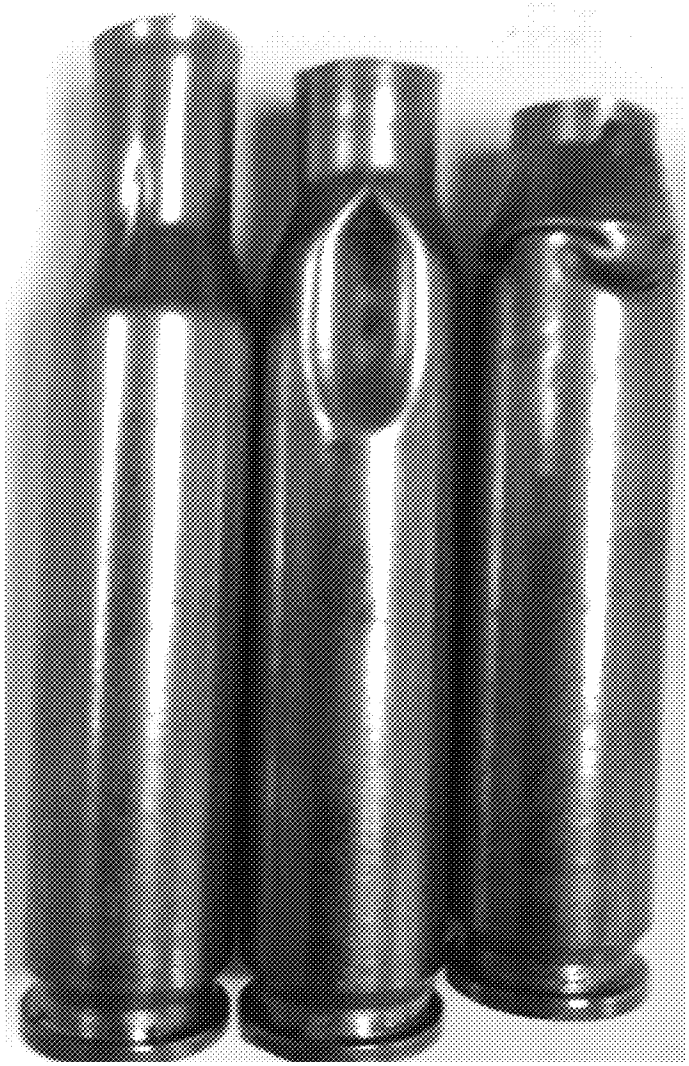
FIG. 6 shows typical defects associated with improper stress relief annealing of the boron steel.

Without stress relief annealing of the case prior to shouldering and necking issues with folding, rippling and cracking of the mouth area can be experienced. FIG. 6 shows typical defects associated with improper stress relief annealing of the boron steel.

Thus, heat treating 106 and tempering 107 of the cartridge case can be used to achieve the desired physical properties. Such physical properties may be functionally desired. After the firing event of a cartridge case, the case may need to spring back in order to allow for the case to be easily extracted from the chamber. Since steel has an elastic modulus (e.g., 30,000 ksi) greater than that of brass (e.g., 16,000 ksi), the yield strength of the steel must also be two times that of brass. Conventional low-to-medium carbon steels cannot achieve this without significant post processing. For boron steel, the desired physical properties include a yield strength of at least 110 ksi. This allows for the cartridge case to be easily extracted from the chamber.

In an example of the heat treatment 106, the cases are heated to a temperature from approximately 1600° F. to approximately 1650° F. (e.g., 1615° F.) and held at this temperature for approximately 25 to 40 minutes (e.g., 38 minutes) then oil quenched (e.g., immediately after heat treatment). In an instance, the temperature is 1615° F. or 1625° F. and the time is from 30 to 38 minutes, though other temperatures and times are possible. The oil quench can be held at 150° F. to maintain the martensite state of the steel. The oil can drain from the case prior to tempering.

After oil quenching, the cases are then tempered 107 in this example by heating the cases to a temperature from approximately 575° F. to approximately 625° F. (e.g., 600° F.) and then holding at this temperature for approximately 2 to 3 hours (e.g., approximately 2 hours) to remove any stresses from the quenching. The rifle cartridge cases are then allowed to slow cool to room temperature. In an instance, the temperature is 300° F. desirable, though other temperatures are possible.

Any heat treatment may be carried out under a protective (endothermic) atmosphere to prevent oxidation and decarburization.

Corrosion protection of the boron steel cases can be achieved using a lacquer coating, nickel plating, and/or other coating/plating.

The design of the rifle cartridge case wall thickness may be configured to accommodate typical operation. The wall thickness can be configured to withstand typical pressure without cracking. The wall thickness also can be configured to control the overall weight of the cartridge case. Using embodiments disclosed herein, the cartridge case wall thickness was decreased on average by 0.005 inches over the length as compared to a previous cartridge case. For example, the decrease in wall thickness may be reduced by 20% to 30% compared to conventional brass casings. The reduction in wall thickness and the increased strength of the boron steel provide the cartridge weight savings. For example, the weight may be reduced by 15% compared to conventional brass casings. This also allowed for the interior volume of the cartridge case to be increased to hold additional propellant.

Spring back of the cartridge case is needed to extract the cartridge from the chamber after firing. Brass has a high yield strength to elastic modulus (e.g., 0.0044 in/in). For steels, the elastic modulus approximately two times higher than that of brass and therefore the yield strength of the steel must be higher than the brass to obtain the same results. A yield strength of at least 120,000 psi for steel may be desirable to achieve a relatively low extraction force. For example, the extraction force—the force required to remove the case from the chamber after the firing event, which varies based on the caliber and other properties of the firearm—chamber pressures of 63,000 psi to 98,000 psi were only 2.9 lbs. to 35 lbs. for the heat-treated boron steel. The extraction force was done with bare steel and no coatings. Brass for this same pressure range would have an extraction force from 19 lbs. to 470 lbs.

Using embodiments disclosed herein, lightweight rifle cartridge cases can be produced with a mass 30% less than that of brass. Resulting monolithic rifle cartridge case can have sufficient strength to withstand pressures in excess of 98,000 psi. A resulting boron steel rifle cartridge case can have spring back properties greater than that of brass at low and elevated pressures to reduce or eliminate extraction force issues at high pressures. A resulting boron steel rifle cartridge case can have the potential to be reloaded for commercial applications. Existing steel cases on the market cannot be reloaded. The resulting rifle cartridge cases have lower cost to manufacture over a brass case based on raw material and a resulting thin wall boron steel rifle cartridge case can have increased volumetric capacity for propellant or a heavier mass bullet. Resulting rifle cartridge cases can provide improved trajectory, increased muzzle velocity of the bullet, and primer retention at high pressure.

A boron steel case may offer adequate projectile retention despite forming a cartridge with less surface area than a similar brass cartridge. This may be useful for (1) moving the cartridge shoulder forward for increased propellant capacity and/or (2) for shortening the case and allowing for projectiles with a longer give to be used.

Since the hardness of the heat-treated boron steel cases may exceed that of conventional weapon barrel steels, prolonged use and associated weapon wear may be of concern. Implementation of a low-strength or low-hardness coating may protect the weapon from any potential damage. For example, this coating may be nickel, tin, zinc, or electroless coatings of zinc or nickel. This coating may also be used to provide a measure of corrosion resistance.

Electroless nickel can provide a superior surface coating for protecting the cartridge case from corrosion.

The current strength and ductility properties can allow the boron steel case mouth to be flared during the loading operation as opposed to other high-strength steel case options that may not exhibit enough plasticity and may require an internal mouth chamber to allow for projectile seating without damage to the soft copper jacket.

Figure 7:
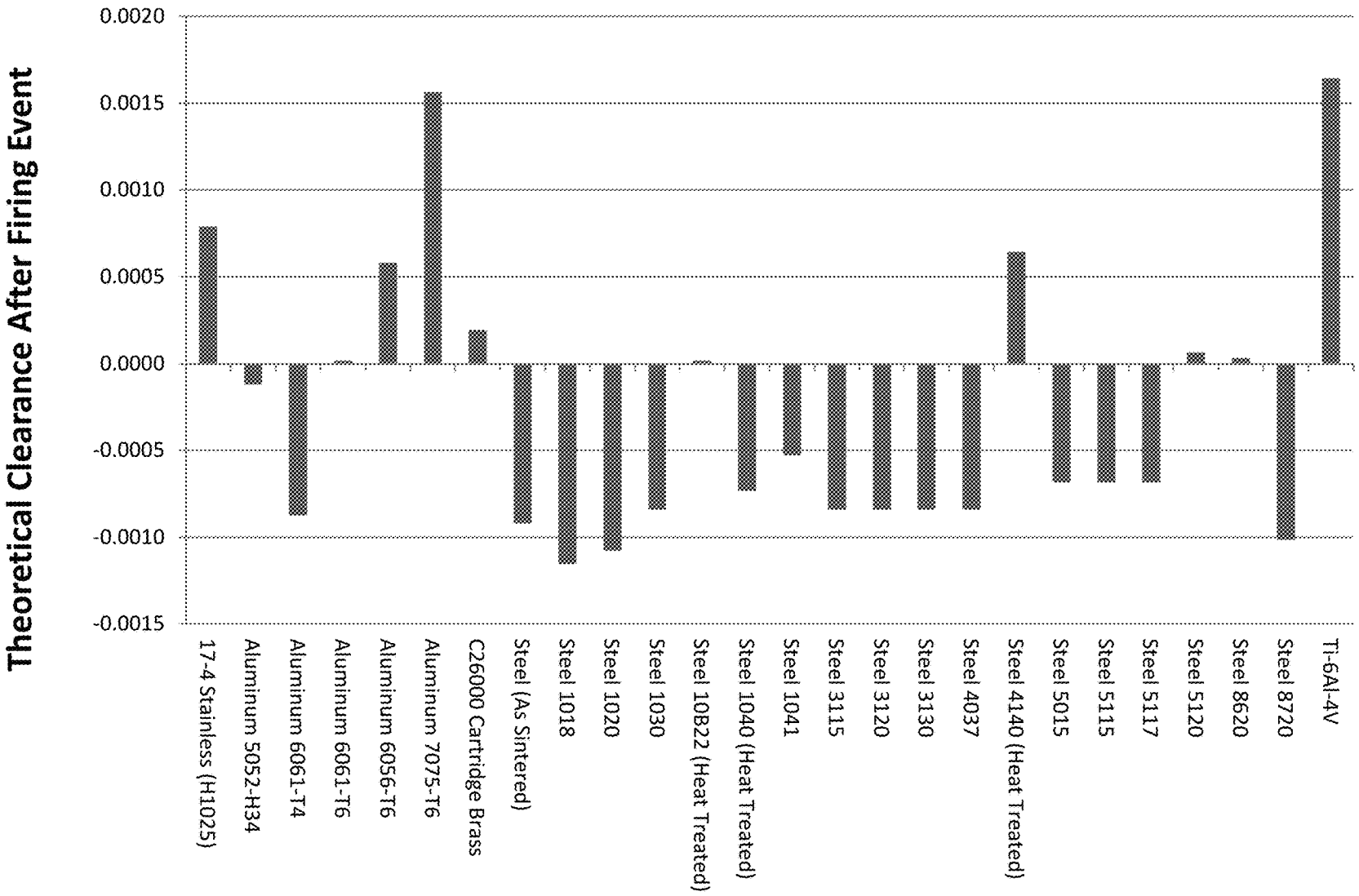
FIG. 7 is a chart showing theoretical clearance after a firing event based on modeling of a cartridge case according to embodiments of the present disclosure.
Figure 8:
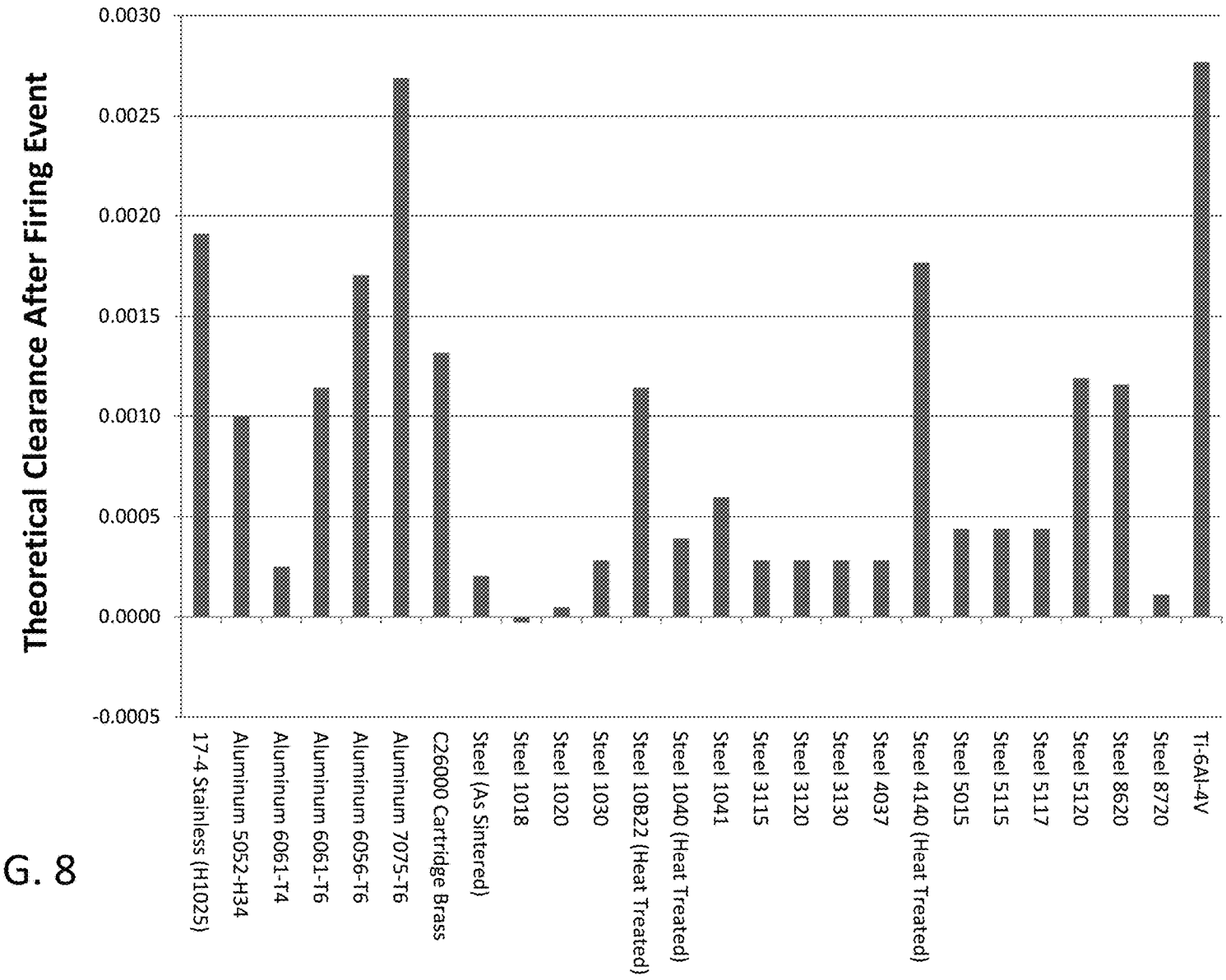
FIG. 8 is a chart showing theoretical clearance after a firing event for a cartridge case having a carbide insert according to embodiments of the present disclosure.

In FIGS. 7 and 8, a model was created to determine a range of materials suitable for the high pressure rifle cartridge case of the present disclosure and relations to formability. The model can determine if a suitable gap would exist after firing at a given pressure between the cartridge case and gun barrel. The model does not take into account potential design and strength issues to prevent cracking or loss of primers after firing. As shown in FIG. 7, some of the tested materials had a theoretical clearance fit after a firing event. As shown in FIG. 8, most of the tested materials had a theoretical clearance fit after a firing event when a carbide insert is added to the gun barrel at the cartridge area.

Using the cartridge casing of the present disclosure, salt spray tests were performed to determine corrosion resistance under the ASTM B117 standard. Table I and Table II provide the results of the tests on various samples.

TABLE I

| Sample | | Base | | Approximate Percentage of Corrosion | | |
|---|---|---|---|---|---|---|
| No. | Cartridge Case | Metal | Plating | 24 Hrs. | 48 Hrs. | 72 Hrs. |
| 1 | 7.62 mm | 10B22 | Zinc Nickel | ~1% White | ~5% White | ~5% White |
| 2 | (762X2010CM001) | | Trivalent RoHS Compliant | ~1% White | ~5% White | ~5% White |
| 3 | 7.62 mm | 1018 | Zynik II | ~20% White | ~30% White | ~30% White |
| 4 | (308-TUBE-001) | | | ~20% White | ~40% White | ~40% White |
| 5 | 7.62 mm | 1018 | Tri-metal | ~1% Red | ~3% Red | ~5% Red |
| 6 | (308-TUBE-001) | | plating | ~1% Red | ~5% Red | ~5% Red |
| 7 | 7.62 mm | 1018 | Electroless Ni | ~10% Red | ~15% Red | ~15% Red |
| 8 | (308-TUBE-001) | | | ~10% Red | ~15% Red | ~15% Red |
| 9 | 7.62 mm | 1018 | Barrel Ducta- | <1% Red | <1% Red | <1% Red |
| 10 | (308-TUBE-001) | | EN HP+ | <1% Red | <1% Red | <1% Red |
| 11 | 7.62 mm | 10B22 | Barrel Ducta- | <1% Red | <1% Red | <1% Red |
| 12 | (762X2010CM001) | | EN HP+ | <1% Red | <1% Red | <1% Red |
| 13 | 7.62 mm | 10B22 | Barrel Ducta- | <1% Red | ~1% Red | ~1% Red |
| 14 | (762X2010CM001) | | EN | No Red | <1% Red | <1% Red |
| 15 | 7.62 mm | 10B22 | EN-3E HP+ | No Red | No Red | No Red |
| 16 | (762X2010CM001) | | | No Red | No Red | <1% Red |
| 17 | 7.62 mm | 10B22 | EN-3E | <1% Red | <1% Red | <1% Red |
| 18 | (762X2010CM001) | | | No Red | No Red | No Red |

TABLE II

| Sample | | Base | | Approximate Percentage of Corrosion | | |
|---|---|---|---|---|---|---|
| No. | Cartridge Case | Metal | Plating | 24 Hrs. | 48 Hrs. | 72 Hrs. |
| 1 | 7.62 mm | 10B22 | Zinc with | ~1% White | ~5% White | ~5% White |
| 2 | (156 g version) | | clear top coat after bake | ~1% White | ~3% White | ~3% White |
| 3 | 7.62 mm | 10B22 | Zinc-Nickel | None | None | None |
| 4 | (156 g version) | | with clear top coat after bake | None | None | None |

According to a desired specification, no red rust, pitting, or corrosion product buildup may be acceptable, but white or gray color film may be acceptable after a 72 hour test. As shown in Table I and Table II above, many of the cartridge casings of the present disclosure satisfy the desired specification of corrosion resistance Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A method comprising:

cold forming a cartridge case into a drawn blank or a tubular component, wherein the cartridge case is fabricated of boron steel that is spheroidized annealed at finished size (SAFS) before cold forming;

annealing the cartridge case using a belt furnace, flame furnace, induction furnace, or a batch furnace;

performing a machine ejector slot and trim on the cartridge case;

forming a shoulder and a neck of the cartridge case;

performing a heat treatment of the cartridge case; and tempering the cartridge case.

2. The method of claim 1, wherein the cartridge case includes a phosphorus and polymer coating.

3. The method of claim 1, wherein the annealing is configured to provide stress relief.

4. The method of claim 1, wherein the annealing occurs at a temperature from between 900° F. and 1100° F. for 10 minutes to 15 minutes.

5. The method of claim 1, wherein the heat treatment occurs at a temperature between 1600° F. and 1650° F. for 25 minutes to 40 minutes.

6. The method of claim 1, wherein the tempering occurs at a temperature between 575° F. and 625° F. for two hours.

7. The method of claim 1, further comprising:

filling an interior volume of the cartridge case with a propellant.

8. The method of claim 7, further comprising:

after firing the cartridge case from a weapon, re-filling the interior volume of the cartridge case with additional propellant.

9. A cartridge case comprising:

a cartridge body having a tubular shape with an ejector slot, a shoulder, and a neck;

wherein the cartridge body is comprised of a boron steel comprising ≤1.0% boron, and the boron steel is spheroidized annealed at finished size (SAFS) before being cold formed into the tubular shape.

10. The method of claim 1, wherein after performing the heat treatment and before tempering the cartridge case, the method further comprises:

oil quenching the cartridge case.

11. The method of claim 10, wherein the oil quenching is performed in an oil held at 150° F., and the oil is drained from the cartridge case before tempering.

12. The cartridge case of claim 9, wherein the boron steel has a yield strength of more than 80,000 psi.

13. The cartridge case of claim 9, wherein the cartridge case withstands a pressure of up to 120 ksi.

14. The cartridge case of claim 9, wherein the boron steel has a hardness between 35 to 45 HRC.

15. The cartridge case of claim 9, wherein the cartridge body includes a surface coating.

16. The cartridge case of claim 15, wherein the surface coating is an electroless nickel plating.

17. The cartridge case of claim 9, wherein the tubular shape of the cartridge body is cold formed from sheared lengths of a coil.

18. The cartridge case of claim 9, wherein the cartridge body is heat treated at a temperature between 1600° F. and 1650° F. for 25 minutes to 40 minutes.

19. The cartridge case of claim 9, wherein the boron steel comprises 0.0008% to 0.0030% boron.

20. The cartridge case of claim 9, wherein the boron steel further comprises:

0.18% to 0.23% carbon;

≤0.25% silicon;

0.7% to 1.0% manganese;

≤0.03% phosphorous; and

≤0.01% sulfur.

* * * * *